US005209373A

United States Patent [19]

Gondek et al.

[11] Patent Number: 5,209,373

[45] Date of Patent: May 11, 1993

[54] VENDING MACHINE WITH SELF-CONTAINED, LIMITED ACCESS MICROWAVE OVEN

[75] Inventors: Charlene Gondek, Boca Raton; Trevor Nicholson, Fort Lauderdale; Leon Zetekoff, Boca Raton; Robert Waszak, Pompano Beach, all of Fla.

[73] Assignee: Vendtron, Inc., Pompano Beach, Fla.

[21] Appl. No.: 886,790

[22] Filed: May 20, 1992

[51] Int. Cl.[5] ..... G07F 11/72

[52] U.S. Cl. ..... 221/150 HC; 221/1; 221/15; 219/10.55 R; 219/10.55 B; 364/479

[58] Field of Search ..... 221/1, 9, 15, 150 HC, 221/150 A; 99/327, 332, 357, 485; 219/10.55 R, 10.55 B, 10.55 D; 364/479

[56] References Cited

U.S. PATENT DOCUMENTS

| | | | |
|---|---|---|---|
| 3,381,605 | 5/1968 | Smith | 99/332 |
| 4,004,712 | 1/1977 | Pond | 221/150 A |
| 4,482,078 | 11/1984 | Reiss | 221/150 A |
| 4,687,119 | 8/1987 | Juillet | 221/150 HC |
| 4,880,954 | 11/1989 | Bennett et al. | 219/10.55 M |
| 4,958,055 | 9/1990 | Shim | 219/10.55 B |
| 5,147,068 | 9/1992 | Wright | 221/150 A |

*Primary Examiner*—H. Grant Skaggs
*Attorney, Agent, or Firm*—Krass & Young

[57] ABSTRACT

A restricted access vending device with included microwave oven. The device includes a cabinet having a refrigerated compartment containing a plurality of product selections, a compressor associated with the refrigerated compartment, and means for vending a particular product selection to a user. The microwave oven is disposed inside the cabinet and shares a common power supply access with the compressor. An access door is disposed in the cabinet between the user and the microwave for limiting access thereto. The door opens upon the vending of a product selection for a preset period of time so that the user may insert the vended product into the oven. Upon activation by the user of a cooking switch, the access door closes and the microwave operates to heat the vended product.

10 Claims, 6 Drawing Sheets

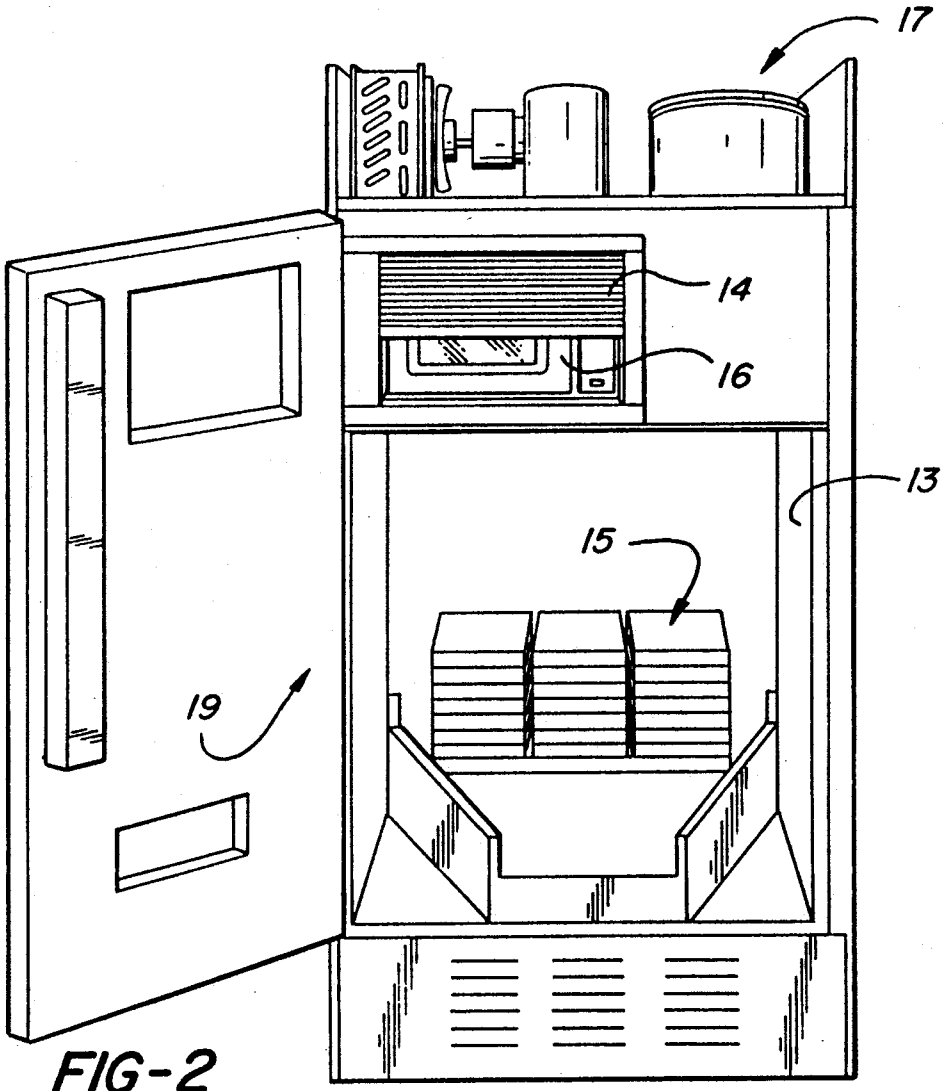
FIG-2
FIG-1
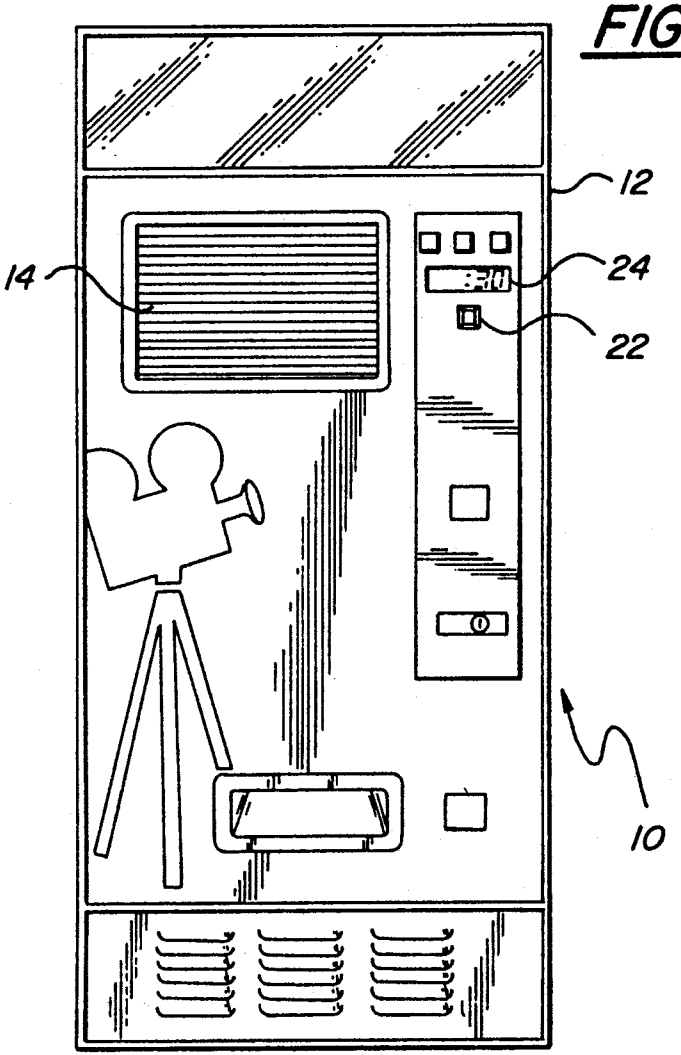

VENDING MACHINE WITH SELF-CONTAINED, LIMITED ACCESS MICROWAVE OVEN

FIELD OF THE INVENTION

The present invention concerns the field of machines for vending a selected one of a plurality of food product selections to a user upon the insertion of an appropriate credit token, and, more particularly, to such a vending machine including a refrigerated compartment for containing the plurality of product selections and a self-contained microwave oven for optional heating of the vended product.

DESCRIPTION OF THE RELEVANT PRIOR ART

Everyone is aware of the plethora of vending machines which have appeared in recent years, and which are capable of vending a particular food item selected from a plurality of various selections displayed to the user. Generally, such vending machines are coin operated, or may accept non-currency credit tokens, paper currency, or even credit cards.

Many of these vending machines include refrigerated compartments for the vending of food items which must be stored at below room temperatures to prevent spoilage thereof. Of course, some of these chilled items are appropriately eaten in their chilled condition, such as ice cream, fruit, soft drinks, etc. However, in many cases, at least some of the items are such that they are much more appetizing if heated before eating. Such items include, for example, soup, hot dogs, pizza, pasta products, etc.

Certain difficulties are encountered in any attempt to vend items which must be stored under chilled conditions, yet should be reheated for maximum enjoyment. For example, a vending machine having a chilled compartment may be located next to a microwave oven in a cafeteria or canteen location so that the chilled, vended product may be placed by the purchaser in the microwave oven for heating. However, such an arrangement has the highly undesirable feature of allowing open access to the microwave oven so that it may be used for other purposes than reheating the vended products. In such circumstances, it is not unusual to have lines forming at the microwave oven wherein people who have actually purchased the vended items must wait their turn until others finish heating foods purchased elsewhere or brought from home.

There have been a few attempts in the prior art to solve their problem of limiting access to the microwave oven to those who have purchased a vended item. For example, U.S. Pat. No. 3,381,605 discloses a vending machine having an associated microwave oven wherein the microwave oven door is opened in response to the dispensing of a food product to permit access and closes automatically after reopening at the end of a heating period. U.S. Pat. No 4,004,712 discloses a vending machine and microwave oven combination wherein the vending machine includes a separate electrical outlet into which is plugged the microwave oven unit. The circuitry of the vending machine includes a first relay which is operable, upon vending of the item by the vending machine, to permit energization of the electrical outlet for a preset period of time so that the oven may operate. A second relay in the vending machine permits energization of the outlet and maintains it in the energized state independent of the oven cooking time control. Thus, the circuitry will permit the oven to be used for a preset period of time. If it is not used, energization of the outlet is discontinued. Once the microwave starts running, a second relay keeps the outlet energized for as long as the microwave oven is on.

The devices disclosed in both of these references suffer from a similar problem that they still permit unauthorized access to and use of the microwave oven. Furthermore, since the oven is not contained in the vending machine cabinet, but merely left out in the open, it poses a hazard to children and those unfamiliar with both its use and the safety precautions which should be taken. Therefore, vending machines using exposed microwave ovens are inherently unsafe, have trouble gaining regulatory approval, and have not come into widespread usage.

There is another category of vending machines having both microwave ovens and refrigerated compartments which do not allow user access to the microwave oven. These machines automatically transfer the product selection directly from the refrigerated compartment into the microwave oven for subsequent heating. Only after the product is heated, is it dispensed to the user. Examples of such machines are described in U.S. Pat. Nos.: 3,386,550; 3,343,479; 3,397,817; 3,404,620; 3,442,200; 3,534,676 and 4,592,485. Since this type of machine overcomes the problem of free user access to the microwave oven, it has come into fairly wide usage. However, it does suffer from some significant drawbacks. For example, the vending cycle of such a machine is very long since the machine must go through the entire heating period before it is free to vend another article. This long cycle time represents "down time" for the vending machine, with concomitant user frustration and lost revenue. Furthermore, the user may not wish to have the chilled article heated, at all, but may wish to simply retrieve it from the machine in its chilled condition. The type of machine described in the above listed references does not permit this option. Yet, such an option is particularly desirable when the vending machine is located in areas where at least some of the users have access to their own microwave ovens or other heating devices, such as in hotel lobbies, office buildings, dormitories, etc.

Consequently, there is a need for a vending machine which is capable of storing chilled articles and dispensing them to a user for subsequent reheating in a self-contained microwave oven unit. There exists a further need for such a vending machine wherein the user has the option of either heating the product selection or simply removing it as is.

SUMMARY OF THE INVENTION

Accordingly, the restricted access vending machine of the present invention has been designed to overcome the problems noted above. The vending machine includes a cabinet having a refrigerated compartment for containing a plurality of product selections, a compressor associated with the refrigerated compartment, and means for vending a particular product selection from the compartment to a user upon the insertion of a credit item, such as coins, bills, credit cards, etc.

The vending machine of the present invention includes a means for heating the chilled product selection, such as microwave oven which is disposed inside the cabinet. An access door is also disposed in said cabinet between the user and the microwave oven for limiting user access to the oven unit. Upon the vending of the product selection, the door is operative to open for a first, preset period of time so that the vended product selection may be inserted by the user into the oven during this first time period.

The vending machine further includes a user activatable cooking switch which, if activated during the first period, closes the access door and turns the microwave oven on for a second preset period of time to heat the selection. Thus, upon the vending of an item, the user may activate the cooking switch during the first time period. Since the access door is open during this period, the user will have access to the microwave oven, and may open up its door, and place the product selection in the oven. If the user activates the cooking switch, the access door then closes, and the microwave oven is energized for the second preset time period to heat the product selection. If, however, the user elects not to activate the cooking switch, the access door simply closes at the end of the first preset time period, thus allowing the machine to be available for vending subsequent items.

If the user elects the cooking option, the access door remains closed during the entire time the microwave is activated. Upon expiration of the second time period, the door then opens to allow the user access so that the heated product selection can be removed. It remains open for a third preset time period, and automatically closes at the end of the third period so that the machine is ready to vend subsequent items.

The restricted access vending device of the present invention further includes means for powering the compressor and the microwave oven in the form of a grounded power line which is insertable into a standard electrical outlet. In order to avoid overload of the power circuit caused by simultaneous operation of the compressor and the microwave oven (both of which consume large amounts of electrical power), the device includes a switch for cutting off the power to the compressor when the microwave oven is in operation. The inclusion of the power cut-off switch and the access door to limit free access to the microwave oven results in a vending device which both contains no electrical hazards, and is also completely safe to operate.

In one embodiment of the vending device of the present invention, it further includes a preprogrammed, microprocessor controller which controls the operation of the compressor, the microwave oven, the power cut-off switch, the access door, and the cooking switch so that the vending device operates in accord with a preprogrammed sequence. In this embodiment, the solid state controller is programmed first to operate the vending means to deliver the product selection from the refrigerated compartment to the user upon insertion of the credit item. The controller then starts the first preset time period running and opens up the access door, which remains open during the first time period. The controller is further programmed to respond to activation of the cooking switch during the first time period by: closing the access door; activating the cut-off switch to cut-off power to the compressor for a fourth, preset period of time; starting the second preset period of time running; and turning on the microwave oven. At the end of the second preset period of time, the controller is further programmed to turn off the microwave oven, start the third preset time period running, and open the access door. Upon the expiration of the third time period, the controller is programmed to close the access door. The vending device is then in condition to vend additional product selections. At the end of the fourth time period (which is asynchronous with the other events described above), the controller is programmed to activate the cut-off switch to restore power to the compressor.

In a further embodiment of the device of the present invention, the controller may be further programmed to delay opening of the access door for a fifth preset time period after the second preset time period has expired to permit the heated product to "simmer" in the microwave oven. This simmer period, during which time the microwave oven is not operating, helps to ensure that the product selection is evenly heated.

In another embodiment of the device of the present invention, a digital display is included for consecutively displaying time units (seconds) remaining in the second time period to indicate when the product selection will finish heating. That is, the second period is "counted down" so that the user will know how much time remains before heating is completed. Furthermore, other indicator lights may be provided for indicating such things as, for example, that the machine is in its heating cycle, that the machine is in the "simmer" cycle, that the first time period is running and the user may activate the cooking switch, etc.

A method of vending the product from the vending device of the present invention is also described.

BRIEF DESCRIPTION OF THE DRAWINGS

The present invention is best understood with reference to the following detailed description and drawings in which:

FIG. 1 is a front view of a vending device according to the present invention as a user would typically see it;

FIG. 2 shows the device of FIG. 1 with the access door opened to show various internal components thereof;

DETAILED DESCRIPTION OF THE PREFERRED EMBODIMENT

Figure 3A:
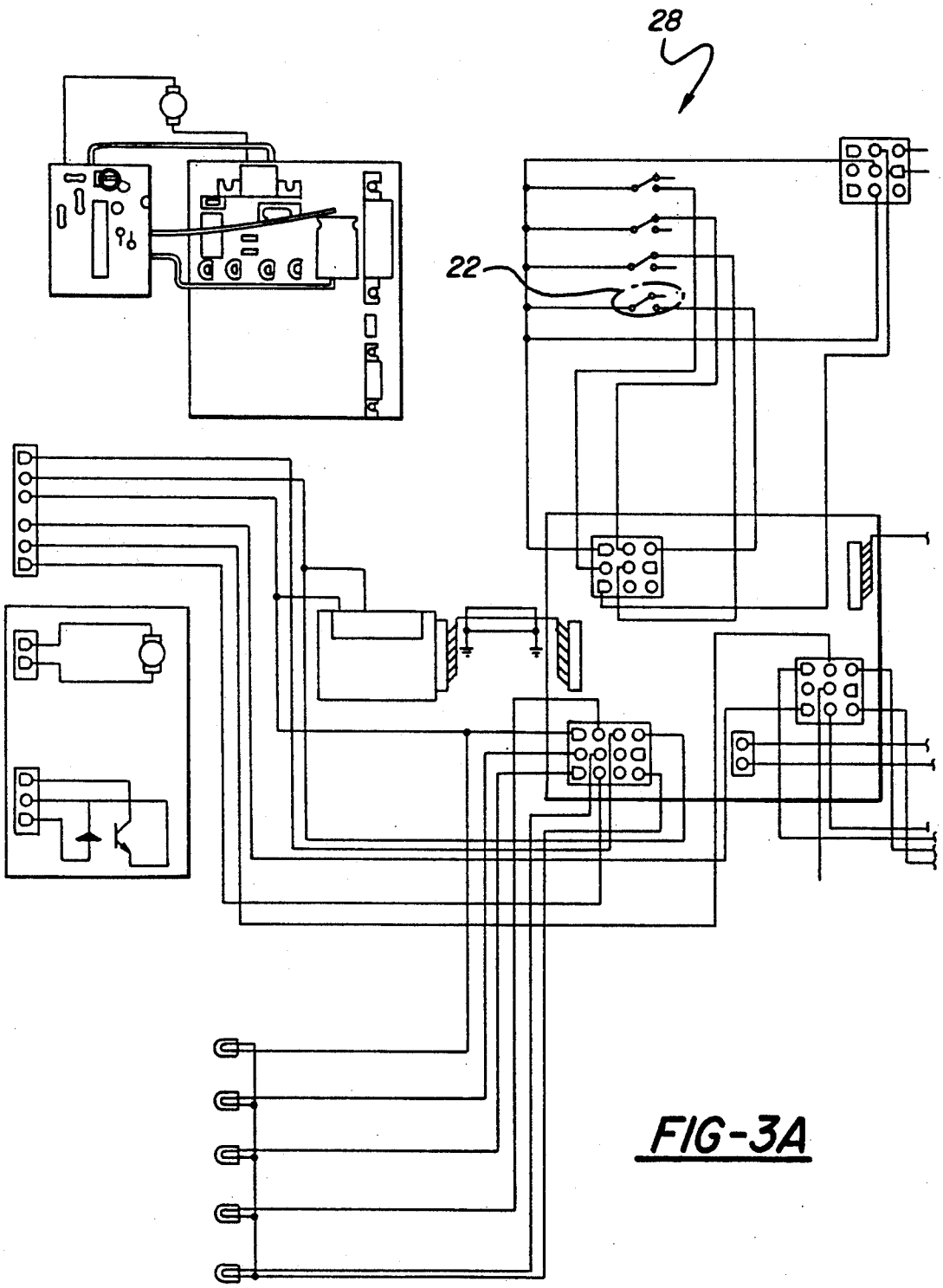
FIGS. 3A and 3B are, taken together, a circuit diagram which has been found useful in implementing the device of the present invention; and FIGS. **4–6*b*** are, taken together, a flow chart which represents schematically the operation of the vending device of the present invention.

Throughout the following detailed description, like reference numerals are used to reference the same element of the invention shown in multiple figures thereof. Referring now to the drawings, and in particular to FIGS. 1 and 2, there is shown a vending device 10 of the present invention which includes a cabinet 12 having an access door 14 mounted in a front face thereof. As can be seen most clearly in FIG. 2, the access door slides up and down to either limit or permit access to a conventional microwave oven unit 16 disposed inside of the cabinet 12. Preferably, the oven unit 16 is disposed so that its controls are not user accessible, but so that the user may open and close the microwave oven door. Also disposed inside the cabinet 12 is a refrigerated compartment 13 containing a plurality of product selections 15 which are shown disposed in stacked formation in several stacks inside compartment 13. A compressor 17 is associated with refrigerated compartment 13 and operates to chill the interior thereof. Also disposed inside cabinet 12 is a means 19 for vending a particular product selection from the compartment 13 to a user (not shown) upon the insertion of a credit item (not shown). As is shown in FIG. 2, the means 19 may consist of a chute through which the product selection drops when the appropriate credit item is inserted, but since the particular vending means is not considered critical to the practice of the present invention, it is not shown in detail. The vending means 19 vends the product selected from the plurality of products 15 to the user via product delivery bin 21, shown in FIG. 1.

Disposed on the front face of the cabinet 12 is a user activatable cooking switch 22 shown as a push button. By pushing switch 22, the user indicates his/her desire to heat a product selection which has been vended to him/her via bin 21. Switch 22 is only activatable for a first, preset period of time after the product selection is vended. If the user delays activating switch 22 until after the first time period has elapsed, it will be ineffective, and the chance to use the oven unit 16 will have passed because access door 14 closes at the end of the first time period if switch 22 is not pushed by the user.

If the user pushes cooking switch 22 at any time during the first time period, the access door 14 will close and the oven unit 16 will begin operation for a second, preset time period. During this second time period, no access to the oven 16 is possible since access door 14 is closed. A digital display 24 is disposed on the front surface of cabinet 12 so that the user can tell how much time remains during the heating cycle. The time remaining in the second, preset time period is sequentially counted down and displayed by digital display 24.

At the end of the second period, the access door 14 again opens to permit the user to remove the heated product selection from the microwave oven unit 16. Again, a third, preset period of time is provided for access to the oven unit 16, at the end of which the access door 14 again closes.

The device of the present invention further includes a cut-off switch 18 (seen in the circuit diagram of FIG. 3) which cuts off power to the compressor 17 while the microwave oven 16 is in operation in a manner which will subsequently be explained in greater detail. Also shown in the circuit diagram of FIG. 3 is the power connection 26 for providing electrical power to both the compressor 17 and the microwave oven 16.

Figure 3B:
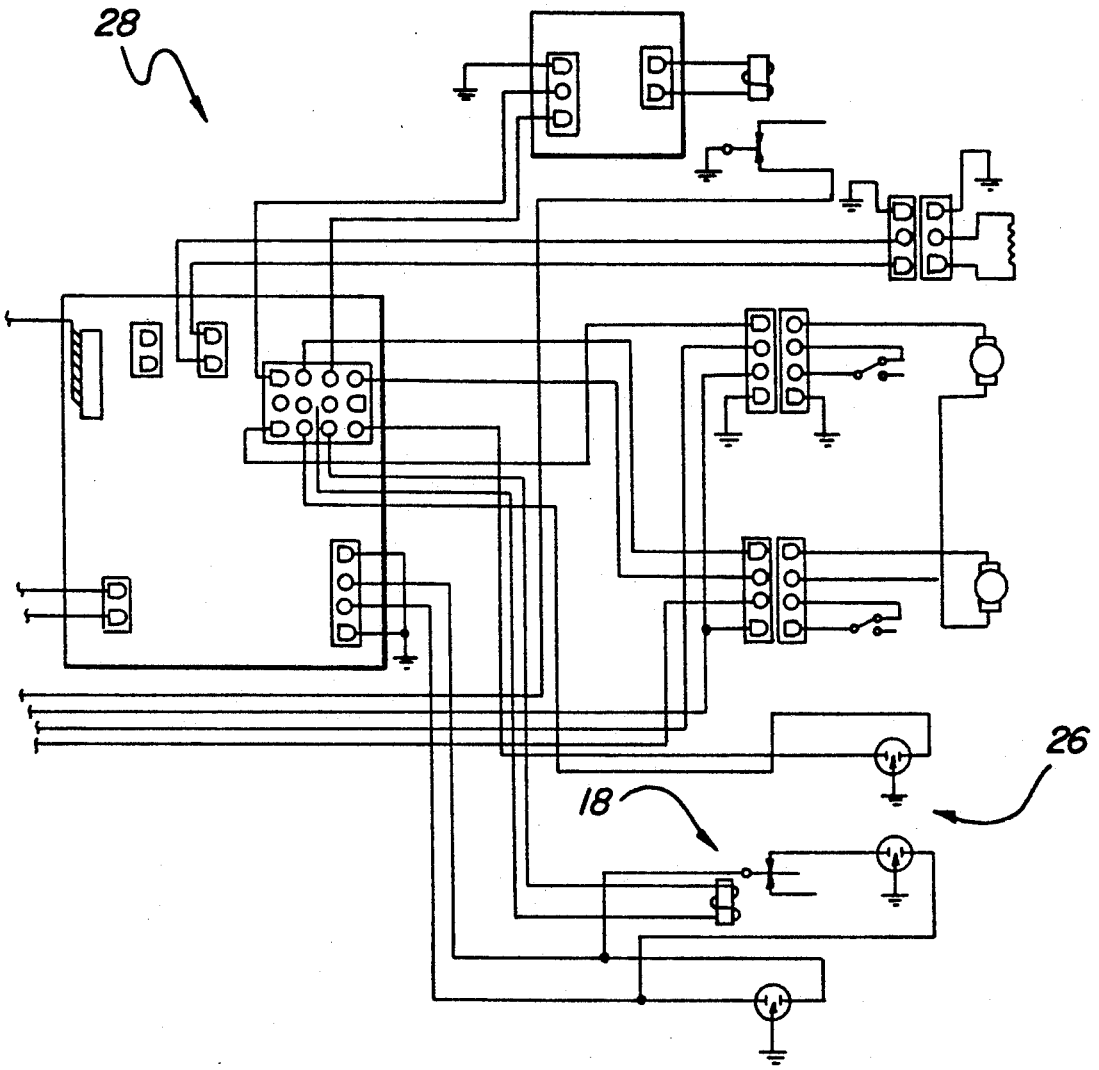
Figure 4:
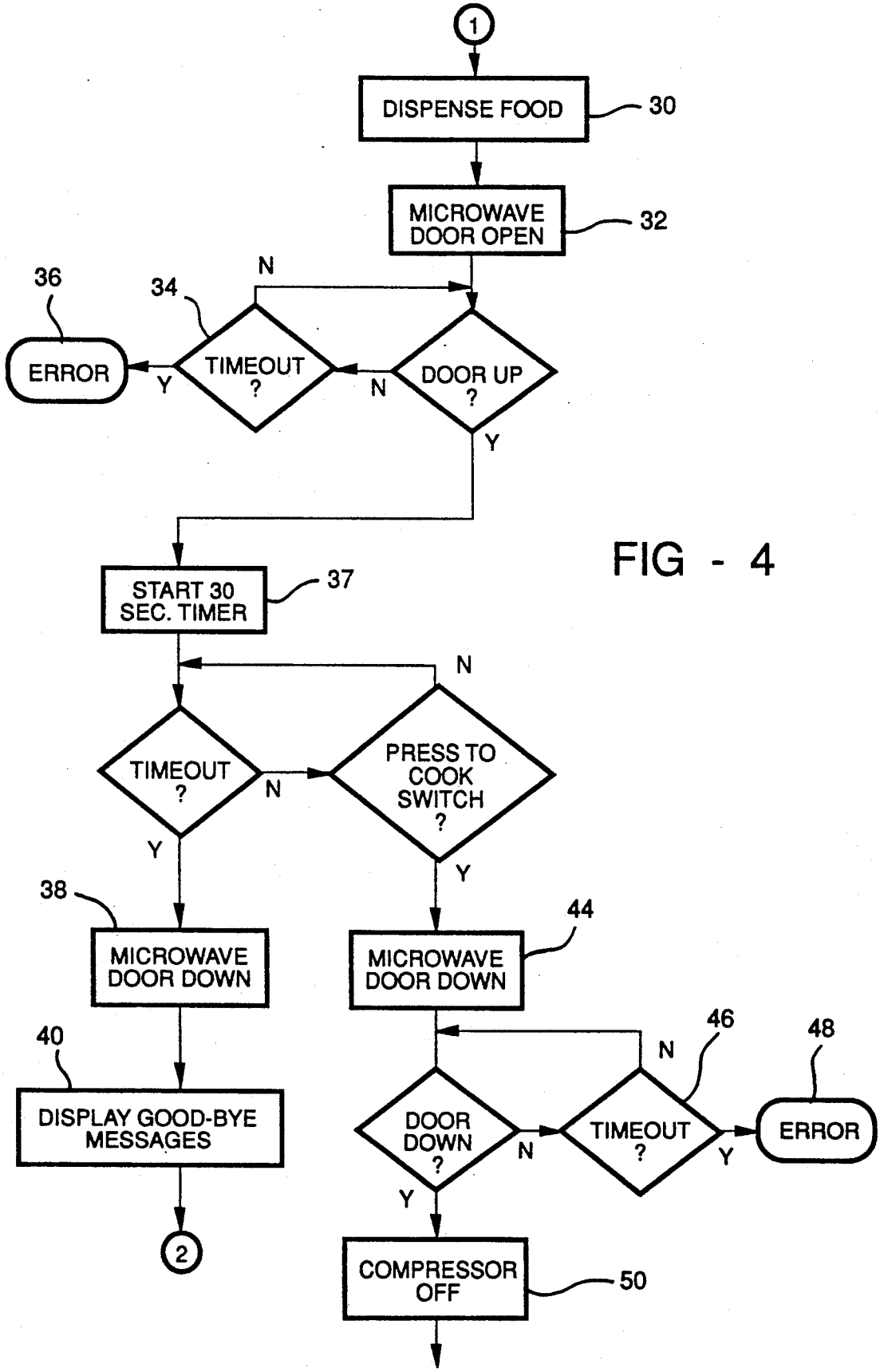

FIGS. 3A and 3B represent is a circuit diagram which includes a microprocessor controller 28 for controlling the sequence of operations performed by the vending device 10. Controller 28 is software driven and is in electrical communication with the access door 14, the cut-off switch 18, the vending means 19, the cooking switch 22, the digital display 24, and the power connection 26 to coordinate and sequence their operation. Controller 28 is, typically an appropriate central processing unit with an associated, preprogrammed PROM.

FIGS. 4–6*b* are various portions of a flow chart which schematically depicts the sequence of operations of the device of the present invention which are under the central control of controller 28. The first portion of the flow chart (FIG. 4) commences at the point where the proper credit item is inserted into the device 10. At that point, the vending means 19 dispenses the product selection, as is shown in box 30. The access door 14 opens up (32) within a time-out period shown at 34. If the door 14 does not go up within the time-out period 34, an error message 36 is displayed. Assuming that the door 14 operates correctly and opens, the controller 28 starts the first preset time period (37) running. If the first time period expires without the activation of cooking switch 22, the microwave door closes (shown in step 38) and appropriate good-by messages 40 are displayed. The unit will then revert to the ready-to-vend condition 42 shown in FIG. 6.

If the user does activate the cooking switch 22, the microwave door 14 will close (step 44). Again, if the door 14 does not close within a time-out period (46), an appropriate error message 48 will be displayed. Assuming that the access door 14 does correctly close, the controller 28 will activate cut-off switch 18 to turn the compressor 17 off (step 50).

Figure 5:
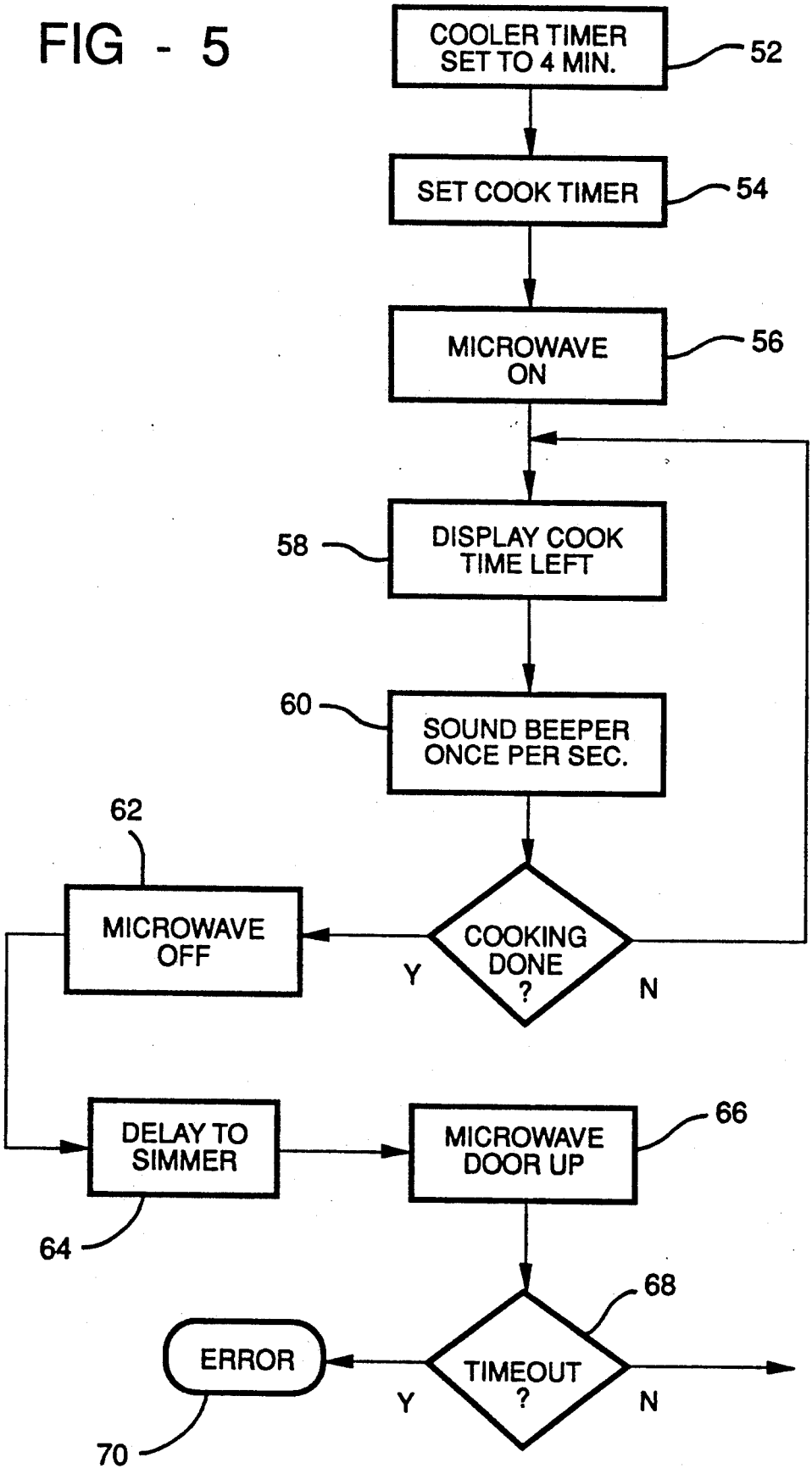

Continuing on to FIG. 5 the controller 28 will then set the fourth preset time period at 52 for a period of time (3 or 4 minutes) that is longer than the second and third time period combined so that the compressor 17 will not resume operation too soon. The controller 28 then sets the second preset time period at 54 and turns the microwave oven 16 on at 56. The time remaining in the second time period is displayed by the digital display 24 at 58 and, optionally, the unit sounds a beeper per second elapsed at 60.

The microwave oven 16 continues in operation during the second time period, and turns off (step 62) at the end of the that period. At this point, the controller 28 can be programmed to start a fifth time period running before the access door 14 opens so that the product selection may "simmer" in the microwave oven 16. This step is shown at box 64. The access door 14 then opens at 66. Again, the door must open up within a preset time-out shown at 68 or an appropriate error message 70 will be displayed.

Figure 6:
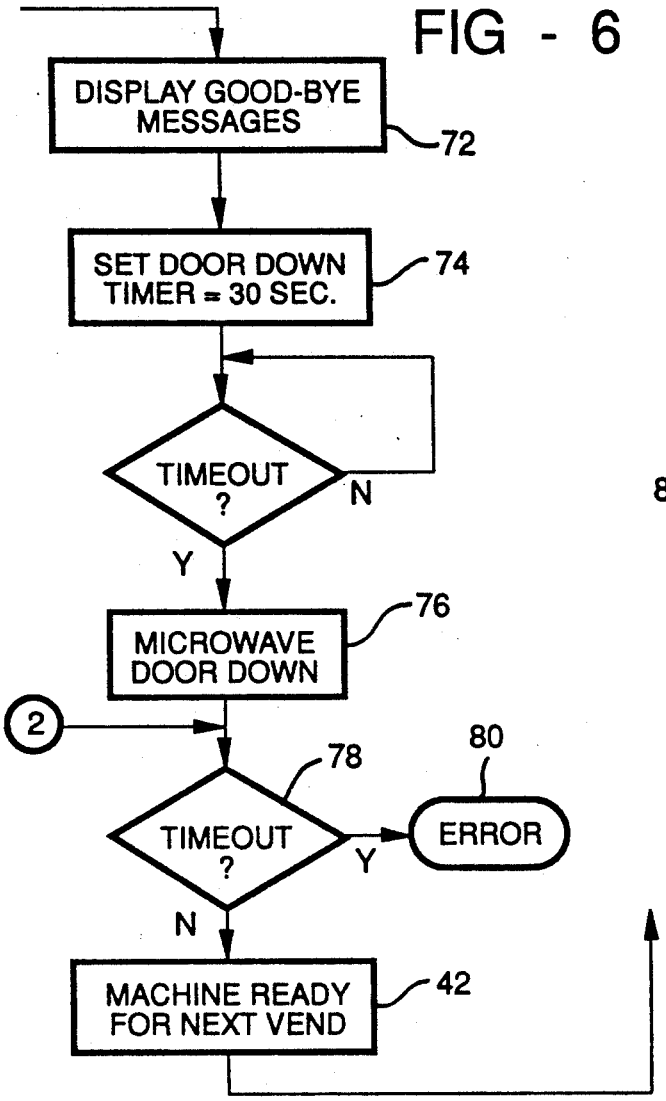

Continuing on with FIG. 6, the unit displays a good-by message at 72, and the controller 28 sets the third time period at 74. At the end of the third time period, the access door 14 again closes at 76. Once again, the door must close within a preset time-out period 78 or an error message 80 will be displayed. Assuming that the access door 16 closes correctly, the machine will then be in a ready condition for the next vend as can be seen in the final box of the flow chart, box 42.

Figure 6A:
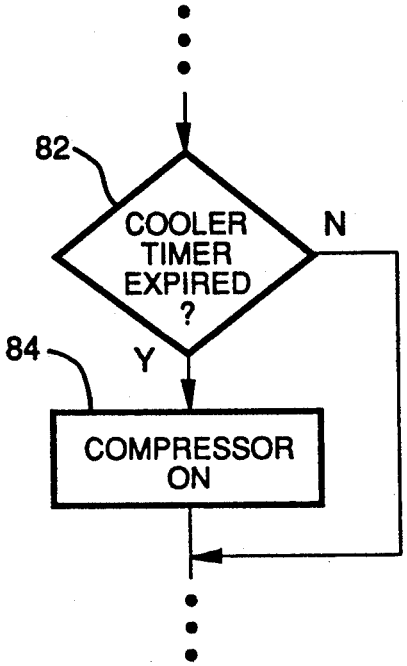

FIG. 6*a* is a portion of the flow chart showing the asynchronous event of the compressor cycle. As previously explained, the compressor is turned off at step 50 and the fourth preset period of time is set at step 52. The operation of compressor cut-off switch 18 is not dependent on the subsequent main sequence of operations, but once activated, operates independently of the main sequence. As can be seen in FIG. 6*a*, if the fourth preset period of time has expired (82), the compressor 17 will turn back on at box 84. Otherwise, the compressor 17 remains off.

Figure 6B:
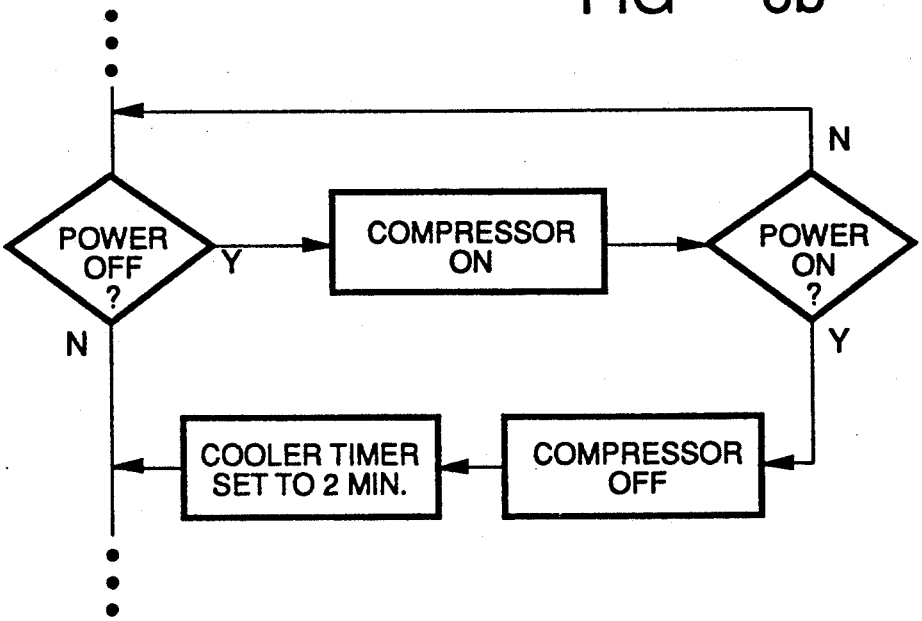

FIG. 6*b* illustrates another safety feature of the device of the present invention which provides a delay period for the compressor to turn back on if a power outage is encountered. If power to the device is accidentally disrupted, it would be highly undesirable for the compressor immediately to turn on once the power supply is resumed. Therefore, the controller 28 provides a preset delay period (shown in box 86) which must elapse before the compressor cut-off switch 18 is activated to restore power to the compressor 17.

Use of the vending device of the present invention is extremely simple. The user indicates his/her product selection and inserts the appropriate credit item or items. The product selection is then vended to him/her from refrigerated compartment 13 via delivery bin 21. The user then removes the chilled selection and, if desired, may simply walk away with it without using the microwave heating capacities of the device of the present invention. The user must make this decision within the first period of time preset by the controller 28. If the user decides to use the microwave oven 16, he/she simply depresses cooking switch 22 at any point during the first preset time period (preferably, switch 22 is lighted during the first preset however, the user does elect the cooking option, he/she may open the door to the microwave oven unit 16 and put the chilled product selection into the oven. The user then closes the door to the oven unit 16, then activates cooking switch 22. The vending device will then operate to close the access door 14, turn off the compressor 17, and start the microwave oven 16 in operation for the second time period. The user may observe digital display 24 to determine how much time remains during the heating cycle.

After the oven has turned off, and the "simmering" period has elapsed, the access door 14 will again open. This allows the user to access the microwave oven unit 16 to open its door and remove the heated product. Again, this must be accomplished during the third preset time period, since the access door 14 closes at the end of this period. After the door closes, another item may be vended from the device 10.

By limiting access to the microwave oven to preset periods of time, and by controlling the operation of the microwave oven internally, the device of the present invention eliminates the hazards presented in the prior art described previously. Furthermore, because the microwave oven unit is contained within the vending device cabinet, it may be appropriately shielded and presents much less of a hazard while in operation. Furthermore, the device presents the user with the option of either activating the cooking cycle, or simply taking the vended product as is. This option frees up the vending device for more frequent vending. Finally, the device of the present invention is This option frees up the vending device for more frequent vending. Finally, the device of the present invention is very easy to use and presents an attractive and eye catching appearance. It is the only vending device containing both a user accessible microwave oven and a refrigerated compartment to be approved by UL, NAMA, and the FDA.

The present invention has been described with regard to certain exemplifications and embodiments thereof. Of course, variations in design of the invention may occur to one skilled in the art, upon reading the present disclosure, without departing from the scope of what is claimed. For example, the access door is shown as a sliding door which slides open from the bottom; it could, however, be a different type of door (a leaf shutter, for example) or could slide back and forth from the side. Such variations fall under the claims of the present invention. Therefore the true scope of the present invention is not limited to the exemplifications and embodiments depicted, but, rather solely by the claims appended hereto and all equivalents thereof.

We claim:

1. A restricted access vending device with included microwave oven, said device comprising:

a vending machine including a cabinet having a refrigerated compartment for containing a plurality of product selections, a compressor associated with said refrigerated compartment, and means for vending a particular product selection from said compartment to a user upon the insertion of a credit item;

a microwave oven disposed inside said cabinet;

a power connection for providing power to said compressor and said microwave oven;

an access door disposed in said cabinet between said user and said microwave oven for limiting access thereto, said door operative to open upon the vending of said product selection for a first .preset period of time so that said vended selection may be inserted by the user into the oven during said first time period; and a user activatable cooking switch which, when activated, closes the access door and turns the microwave oven on for a second preset period of time to heat said selection.

2. The device of claim 1 wherein the access door is further operable to open at the end of said second preset time period to permit access to the microwave for a third preset time period so that said heated selection may be removed therefrom, and to close at the end of said third preset time period.

3. The device of claim 1 further comprising a cut-off switch for cutting of power to the compressor.

4. The device of claim 3 further comprising a preprogrammed, microprocessor controller for controlling the operation of said compressor, said microwave oven, said power cut-off switch, said access door and said cooking switch so that the device operates in accord with a preprogrammed sequence.

5. The device of claim 4 wherein the controller is further programmed to:

operate the vending means to deliver said product selection from said compartment to said user upon the insertion of said token;

start the first preset time period running;

open up the access door;

in response to activation of the cooking switch within the first preset time period, start the second preset period of time running, close the access door, and activate the cut-off switch to cut-off power to the compressor for a fourth preset period of time;

start said third preset time period running and open the access door; and close the access door upon the expiration of said third time period; and activate the cut-off switch to restore power to the compressor at the expiration of said fourth time period.

6. The device of claim 5 wherein the controller is further programmed to delay opening of the access door for a fifth preset period of time after the second preset period has expired to permit the heated product to simmer in the microwave oven.

7. The device of claim 1 further including a count down, digital display for consecutively displaying time units remaining in the second time period to indicate when the product selection will finish heating.

8. A solid state controller for controlling the operations of a vending machine including a cabinet including a refrigerated compartment containing the plurality of product selections, a compressor associated therewith, a rapid heating means disposed inside the cabinet, a power connection to a power source for powering the compressor and the rapid heating means, a switch for cutting off power to the compressor, vending means for vending a particular product selection from said refrigerated compartment to a user upon the insertion of a credit unit, and an access door disposed in the cabinet between the user and the rapid heating means for limiting access thereto, said controller comprising:

a microprocessor which is preprogrammed to:

operate the vending means to vend said product selection to said user upon the insertion of said token;

open the access door for a first, preset time period to permit access to the rapid heating means so that said selection may be exposed thereto;

in response to a signal received during the first time period from a user activatable cooking switch, close the access door, turn on the rapid heating means for a second, preset period of time, and cut off the power supply to the compressor for a fourth, preset time period;

upon the expiration of the second time period, open the access door to permit the heated selection to be removed from the heating means for a third, preset period of time;

close the access door at the expiration of said third preset period of time; and restore power to the compressor at the end of the fourth preset time period.

9. A method of vending a refrigerated product to a user for subsequent heating, said method comprising the steps of:

providing a vending machine including a cabinet having a refrigerated compartment for containing a plurality of product selections, a compressor associated with said refrigerated compartment, means for vending a particular product selection from said compartment to a user upon the insertion of a credit item, a microwave oven disposed inside the cabinet, a power connection for providing power to said compressor and said microwave oven from a power source, a switch for cutting off the power connection to the compressor, an access door disposed in the cabinet between the user and the microwave oven for limiting user access thereto, and a user activatable cooking switch for closing the access door and turning the microwave oven on;

vending said product selection to said user upon insertion of said token;

opening said access door for a first preset time period to allow access to said microwave oven so said vended product selection maybe placed therein;

upon activation of said cooking switch, closing said access door and turning on the microwave oven for a second preset period of time to heat said selection;

turning off said power supply switch to said compressor for a fourth, preset time period;

opening said access door at the end of said second period leaving said access door open for a third preset period of time so that the heated product may be removed from the oven;

closing said access door at the end of the third preset time period; and restoring power to the compressor at the end of the fourth preset time period.

10. The method of claim 9 including the further step of delaying opening of the access door for retrieval of the heated product for a fifth preset period of time after the second preset period has expired to permit the heated product to simmer in the microwave oven.

* * * * *

UNITED STATES PATENT AND TRADEMARK OFFICE

CERTIFICATE OF CORRECTION

PATENT NO. : 5,209,373

DATED : May 11, 1993

INVENTOR(S) : Vendtron, Inc.

It is certified that error appears in the above-identified patent and that said Letters Patent is hereby corrected as shown below:

Column 5, Line 45, Delete "represent is a" Insert --represent a--

Signed and Sealed this

Twenty-second Day of February, 1994

*Attest:*

Bruce Lehman

BRUCE LEHMAN

*Attesting Officer*

*Commissioner of Patents and Trademarks*